US010065435B1

(12) United States Patent
Ernst et al.

(10) Patent No.: US 10,065,435 B1
(45) Date of Patent: Sep. 4, 2018

(54) SELECTIVELY POWERING MULTIPLE MICROWAVE ENERGY SOURCES OF A DRYER FOR A PRINTING SYSTEM

(71) Applicants: Larry M Ernst, Longmont, CO (US); Andrew David Norte, Westminster, CO (US)

(72) Inventors: Larry M Ernst, Longmont, CO (US); Andrew David Norte, Westminster, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/442,689

(22) Filed: Feb. 26, 2017

(51) Int. Cl.

| | |
|---|---|
| ***H05B 6/78*** | (2006.01) |
| ***H05B 6/80*** | (2006.01) |
| ***B41J 11/00*** | (2006.01) |
| ***B41J 13/00*** | (2006.01) |
| ***F26B 3/347*** | (2006.01) |
| ***H05B 6/70*** | (2006.01) |

(52) U.S. Cl.
CPC ..... *B41J 11/002* (2013.01); *B41J 13/0009* (2013.01); *F26B 3/347* (2013.01); *H05B 6/707* (2013.01); *H05B 6/78* (2013.01); *H05B 6/80* (2013.01)

(58) Field of Classification Search
CPC ..... B41J 11/002; B41J 13/0009; F26B 3/347; H05B 6/707; H05B 6/78; H05B 6/80
USPC ..... 347/16
See application file for complete search history.

(56) References Cited

U.S. PATENT DOCUMENTS

| | | | | |
|---|---|---|---|---|
| 3,500,012 A * | 3/1970 | Hilton | H05B 6/78 | 219/693 |
| 4,870,236 A * | 9/1989 | Berggren | H05B 6/782 | 219/691 |
| 5,422,463 A | 6/1995 | Gooray et al. | | |
| 5,631,685 A * | 5/1997 | Gooray | B41J 11/002 | 101/488 |
| 6,259,077 B1 | 7/2001 | Drozd et al. | | |

(Continued)

OTHER PUBLICATIONS

Frederick W. Ahrens; Application of a Device for Uniform Web Drying and Preheating Using Microwave Energy; Final Report; Sep. 2003.

*Primary Examiner* — Huan Tran
*Assistant Examiner* — Alexander D Shenderov
(74) *Attorney, Agent, or Firm* — Duft Bornsen & Fettig LLP

(57) ABSTRACT

Systems and methods for selectively powering multiple microwave energy sources in a dryer of a printing system. One embodiment is a microwave dryer that includes microwave energy sources configured to generate electromagnetic energy to dry a wet colorant applied to a continuous-form print media by a printer. The microwave dryer also includes waveguides configured to transport the electromagnetic energy. The waveguides include a passageway to pass the print media through the waveguides as the print media travels along a media path. A long axis of each the waveguides are positioned in a direction along the media path, and each waveguide is coupled to a different microwave source to section the electromagnetic energy into regions that are distinct from one another in a direction across the media path. The microwave dryer further includes a controller configured to regulate a power output for each of the microwave energy sources.

21 Claims, 5 Drawing Sheets

(56) References Cited

U.S. PATENT DOCUMENTS

| | | | | |
|---|---|---|---|---|
| 6,425,663 | B1 * | 7/2002 | Eastlund | B41J 2/01 219/691 |
| 6,566,660 | B1 | 5/2003 | Stowe | |
| 6,888,115 | B2 | 5/2005 | Drozd | |
| 6,906,297 | B2 | 6/2005 | Tops | |
| 7,470,876 | B2 * | 12/2008 | Drozd | H05B 6/701 219/695 |
| 8,061,833 | B2 | 11/2011 | Onozawa et al. | |
| 8,287,115 | B2 | 10/2012 | Shinkawa | |
| 8,820,913 | B2 | 9/2014 | Koase et al. | |
| 8,833,924 | B2 | 9/2014 | Velasco et al. | |
| 8,985,756 | B2 | 3/2015 | Boland et al. | |
| 9,006,626 | B2 | 4/2015 | Chang et al. | |
| 9,186,915 | B2 | 11/2015 | Hasebe et al. | |
| 9,358,809 | B2 | 6/2016 | Biegelsen | |
| 2007/0140718 | A1 * | 6/2007 | Mulder | G03G 15/2053 399/69 |
| 2016/0236485 | A1 * | 8/2016 | Tossaint | B41J 11/002 |

* cited by examiner

SELECTIVELY POWERING MULTIPLE MICROWAVE ENERGY SOURCES OF A DRYER FOR A PRINTING SYSTEM

FIELD OF THE INVENTION

The invention relates to the field of printing systems, and in particular, to microwave dryers of printing systems.

BACKGROUND

Production printing systems for high-volume printing typically utilize a production printer that marks a continuous-form print media (e.g., a web of paper) with a wet colorant (e.g., an aqueous ink). After marking the print media, a dryer downstream from the production printer is used to dry the colorant. One such dryer is a microwave dryer that uses microwave energy to heat the colorant to cause a liquid portion of the colorant to evaporate, thereby fixing the colorant to the print media.

A typical type of microwave dryer includes a single microwave source that directs microwave energy down a long axis of a waveguide which extends along a travel path of the print media. As the print media traverses the long axis of the waveguide, the wet colorants applied to the continuous-form print media are exposed to the microwave energy. The electromagnetic energy is uniformly distributed over the print media. However, the single microwave energy source is limited in its ability to efficiently adapt to a range of different drying requirements.

SUMMARY

Embodiments described herein describe selectively powering multiple microwave energy sources of a microwave dryer of a printing system. Multiple controlled microwave energy sources are each coupled with a waveguide. The waveguides compartmentalize the electromagnetic energy generated by the microwave energy sources in distinct regions across the width of print media. One advantage of such a configuration is that the microwave dryer is able to precisely control an intensity of electromagnetic energy in each region across the width of web. Accordingly, the microwave dryer may continuously adapt the intensity profile of microwave energy to different web widths and ink amounts for optimum power efficiency and drying performance.

One embodiment is a microwave dryer that includes a plurality of microwave energy sources configured to generate electromagnetic energy to dry a wet colorant applied to a continuous-form print media by a printer. The microwave dryer also includes a plurality of waveguides configured to transport the electromagnetic energy. The waveguides including a passageway that is sized to pass the print media through the waveguides as the print media travels along a media path. A long axis of each the waveguides being positioned in a direction along the media path, and each waveguide is coupled to a different microwave source to section the electromagnetic energy into regions that are distinct from one another in a direction across a width of the media path. The microwave dryer further includes a controller configured to independently regulate a power output for each of the microwave energy sources.

Other exemplary embodiments (e.g., methods and computer-readable media relating to the foregoing embodiments) may be described below. The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, and with reference to the accompanying drawings. The same reference number may represent the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
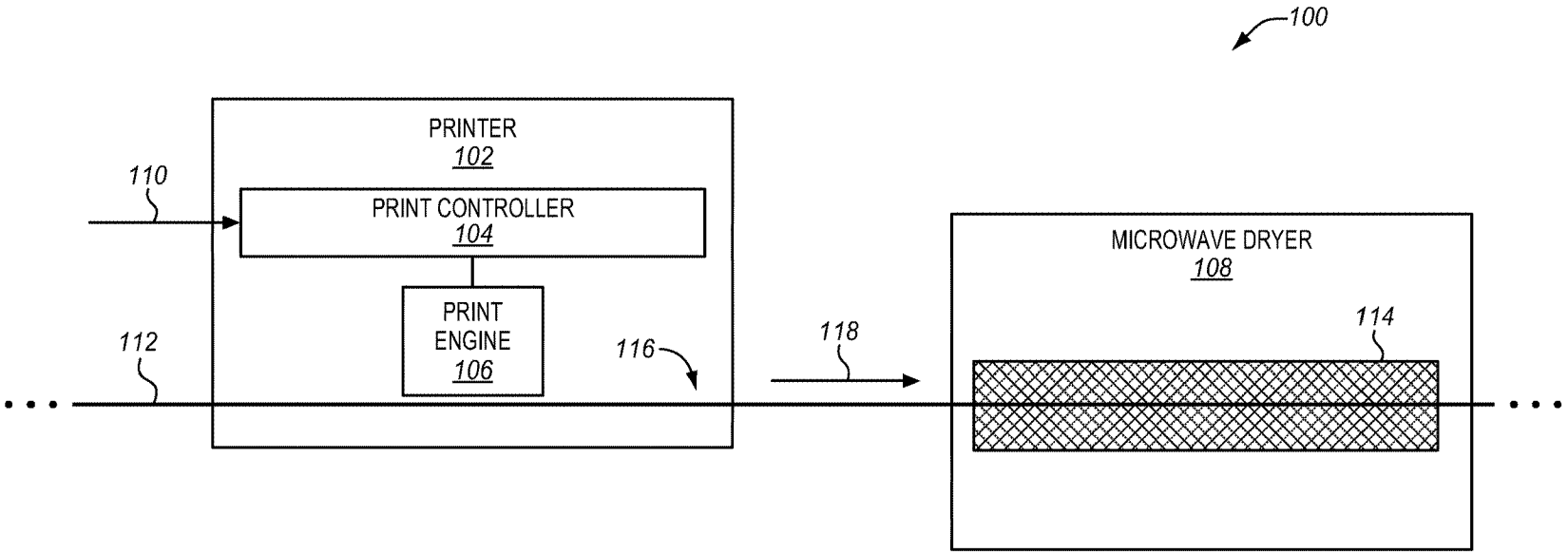
FIG. 1 illustrates an exemplary continuous-forms printing system.

FIG. 1 is a block diagram of a printing system 100 in an exemplary embodiment. Printing system 100 generally includes a printer 102 and a microwave dryer 108. Printer 102 applies a wet liquid or colorant (e.g., aqueous inks, oil-based paints, etc.) to a top surface 116 of print media 112 (e.g., a continuous-form print media such as a paper web). Printer 102 includes a print controller 104 that receives print data 110 and rasterizes print data 110 into bitmap data, and also includes a print engine 106 (e.g., a drop-on-demand print engine, a continuous-ejection print engine, or other printhead ejection type) that uses the bitmap data to apply wet colorant to print media 112. After being marked with wet colorant, print media 112 is guided/transported downstream in travel direction 118. Microwave dryer 108 receives and passes print media 112 and applies electromagnetic energy 114 (e.g., microwave energy) to print media 112 which heats the wet colorants applied to print media 112 to evaporate a liquid portion of the wet colorants, thereby fixing the wet colorants to print media 112.

Conventional microwave dyers of printing systems include a single microwave energy source that emits microwaves lengthwise with print media 112 (i.e., along travel direction 118). This configuration enables uniform distribution of electromagnetic energy across a width of print media 112 for consistent drying results. However, a single microwave energy source is limited in ability to efficiently adapt to a wide range of drying requirements.

Figure 2:
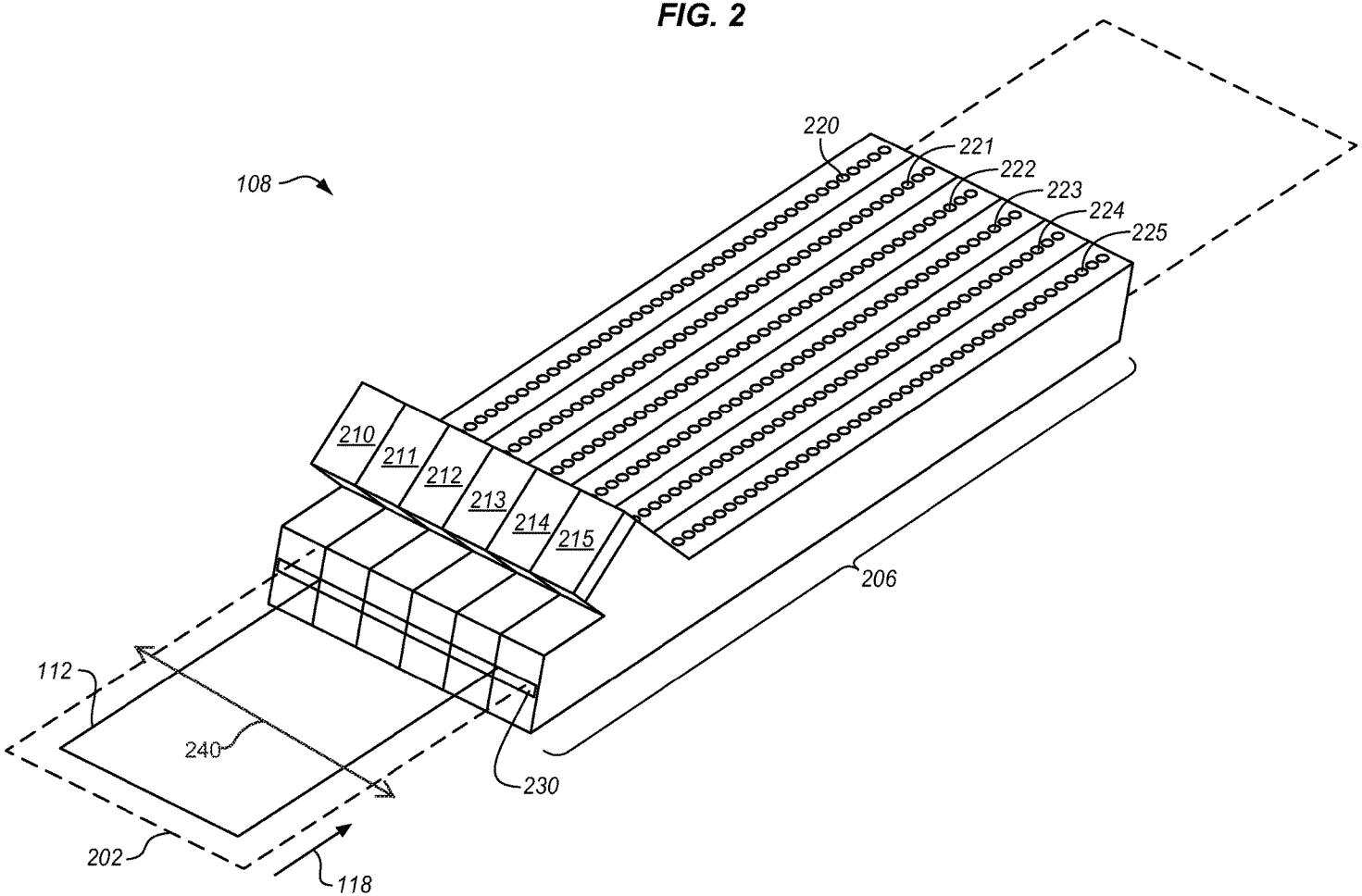
FIG. 2 illustrates a perspective view of a microwave dryer with multiple microwave energy sources and multiple waveguides in an exemplary embodiment.

To improve drying adaptability, microwave dryer 108 may be enhanced with multiple microwave energy sources and multiple waveguides. FIG. 2 illustrates a perspective view of a microwave dryer 108 with multiple microwave energy sources 210-215 and multiple waveguides 220-225 in an exemplary embodiment. In this configuration, microwave dryer 108 is able to emit a custom microwave energy profile for print media 112.

Each microwave energy source 210-215 is configured to transmit high frequency electromagnetic energy (e.g., typically 2.45 GHz or 915 MHz due to standards for operating microwave technology). In one embodiment, each microwave energy source 210-215 may include its own electrical power source that is converted into RF energy by, for example, a magnetron. Waveguides 220-225 are electromagnetically coupled to microwave energy sources 210-215 and configured to transport the electromagnetic energy along a length 206 of waveguides 220-225. The number, size and type of energy sources 210-215, waveguides 220-225 and couplings utilized are a matter of design choice for compatibility with each other, the microwave operating frequency, print media 112 dimensions and/or desired level of performance for drying wet colorants applied to print medium 112 by printer 102.

During operation, print media 112 traverses the length 206 of waveguides 220-225 via a passageway 230 to expose print media 112 to the electromagnetic energy inside each waveguide 220-225 and thereby fix wet colorant to print media 112. The passageway 230 defines a dimension of space for print media 112 inside waveguides 220-225 and includes a length along the length 206 of waveguides 220-225, a width defined by a media path 202, and a vertical height that minimizes leakage of electromagnetic energy between shared walls of adjacent waveguides 220-225. Passageway 230 is sized to pass print media 112. For example, passageway 230 may be sized to pass the widest desired print media 112 though narrower print media 112 may still pass. The width of passageway 230 is less than the width across the waveguides 220-225 in a direction along an axis 240 that is aligned with a width of media path 202, a width of print media 112, a width of passageway 230, and a short axis of waveguides 220-225. Further, the vertical height of passageway 230 may vary based on a frequency of microwave source 210-215 (e.g., vertical height of 1-1.5 centimeters for 2.45 GHz or a vertical height of 3-5 centimeters for 915 MHz). Media path 202 defines a course for print media 112 to follow as it travels through microwave dryer 108. Media path 202 is at least as wide as the widest type of print media 112 handled by printing system 100. Thus, print media 112 may have a similar width as media path 202 or have a narrower width as shown in FIG. 2.

Waveguides 220-225 are generally positioned alongside one another across the width of media path 202. That is, waveguides 220-225 are oriented lengthwise along media path 202 and/or print media 112 (e.g., parallel or substantially parallel with travel direction 118). Each waveguide 220-225 includes a structure that defines a chamber for transporting electromagnetic energy. A long axis of each waveguide 220-225 defines the length 206 along media path 202 with sufficient distance to dry print media 112. A short axis of each waveguide 220-225, having a comparatively shorter distance than the long axis, defines a sectional portion across the width of media path 202. With each waveguide 220-225 electromagnetically coupled with a different microwave energy source 210-215, microwave dryer 108 is able to section the electromagnetic energy of each microwave energy source 210-215 into distinct regions across the width media path 202.

Figure 3:
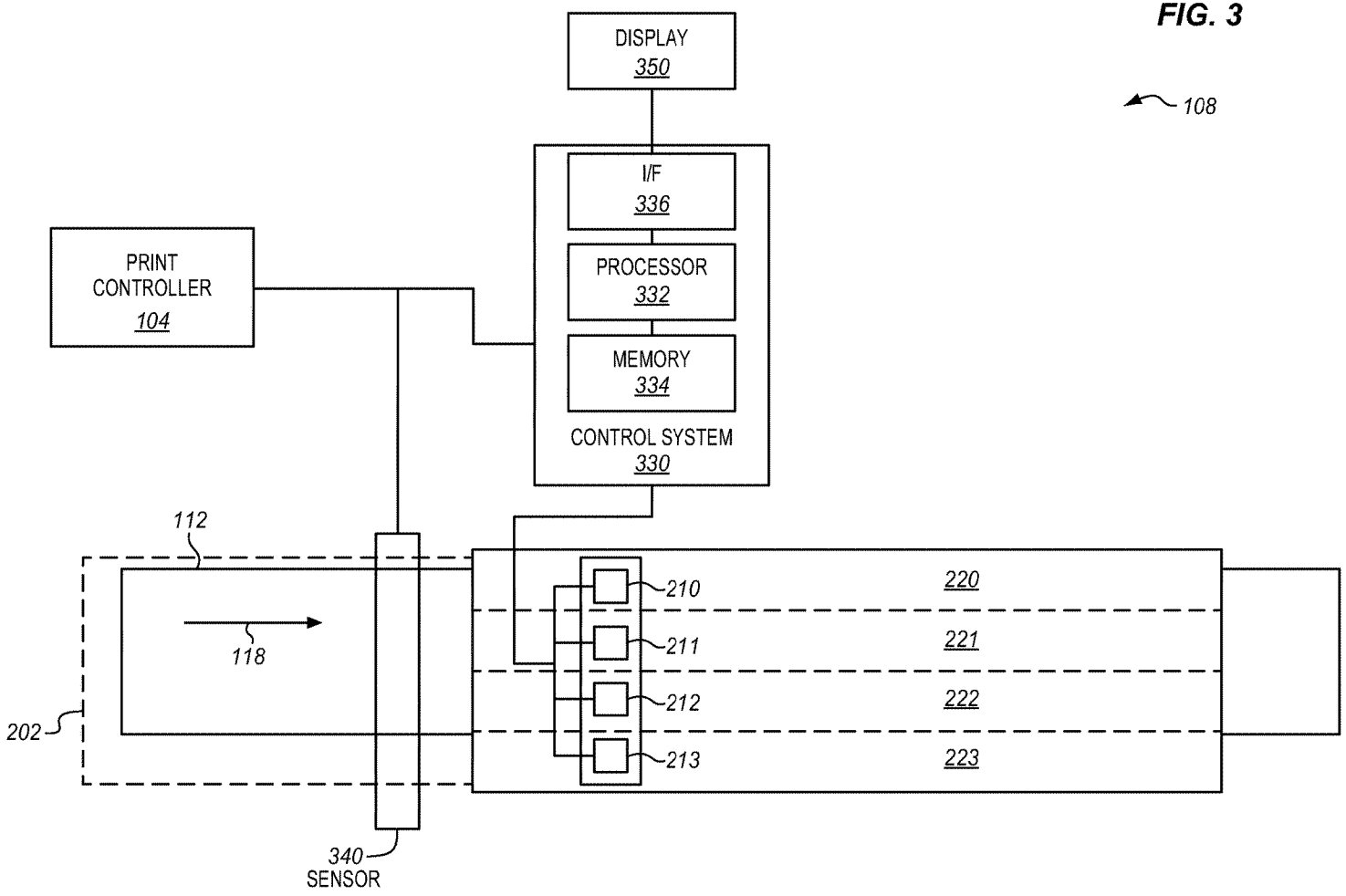
FIG. 3 is a block diagram of a microwave dryer configured to selectively control multiple microwave energy sources in an exemplary embodiment.

FIG. 3 is a block diagram of a microwave dryer 108 configured to selectively control multiple microwave energy sources 210-213 in an exemplary embodiment. FIG. 3 illustrates a top view of microwave energy sources 210-213 each electromagnetically coupled with a different waveguide 220-223 in a similar configuration described above in FIG. 2. Microwave dryer 108 is further enhanced with a control system 330 configured to control a power output for each of microwave energy sources 210-213. For example, control system 330 may independently regulate the electrical power source of each microwave energy source 210-213. With this configuration, microwave dryer 108 may tune its effective drying energy profile across the width of media path 202 for efficient adaptation to a wide range of drying requirements.

Control system 330 comprises any system, component, or device operable to selectively control microwave energy sources 210-213 based on a determined drying requirement. In that regard, control system 330 may be communicatively coupled with various optional inputs, such as print controller 104, sensor 340, and/or display 350. Using one or more of these inputs, control system 330 may determine an optimal level of electromagnetic energy to inject into each waveguide 220-223 to heat the wet colorants applied to print media 112.

Control system 330 may be implemented, for example, as custom circuitry, as a processor executing programmed instructions stored in an associated program memory, or some combination thereof. In this embodiment, control system 330 includes a processor 332, memory 334, and interface (I/F) 336. Processor 332 manages the operations of control system 330 by executing instructions stored in memory 334 which may be implemented as a solid state memory, spinning disk, etc. I/F 336 communicatively couples (e.g., via a bus, network, etc.) control system 330 with print controller 104, sensor 340, display 350, and/or microwave energy sources 210-213.

The particular arrangement, number, and configuration of components described herein is exemplary and non-limiting. For instance, though different numbers of waveguides are shown in FIG. 2 and FIG. 3, any number of waveguides may be provided that span a maximum expected width of print media 112 that propagates through the microwave dryer, and any suitable number of microwave energy sources may be managed by control system 330. Display 350 may comprise any suitable screen or device to visually present graphical user interfaces (GUIs) to users for input (e.g., via a keyboard, mouse, touchscreen, etc.). Sensor 340 may be placed upstream (as shown) of, downstream of or within waveguides 220-223 as desired, and may include a laser, pneumatic, photoelectric, ultrasonic, infrared, optical, or any other suitable type of sensing device to detect a characteristic for all of and/or a region of print media 112, such as a width of print media 112, colorant amount in a particular region of print media 112, colorant dryness of print media 112, etc. Additional details of operation of microwave dryer 108 are described below.

Figure 4:
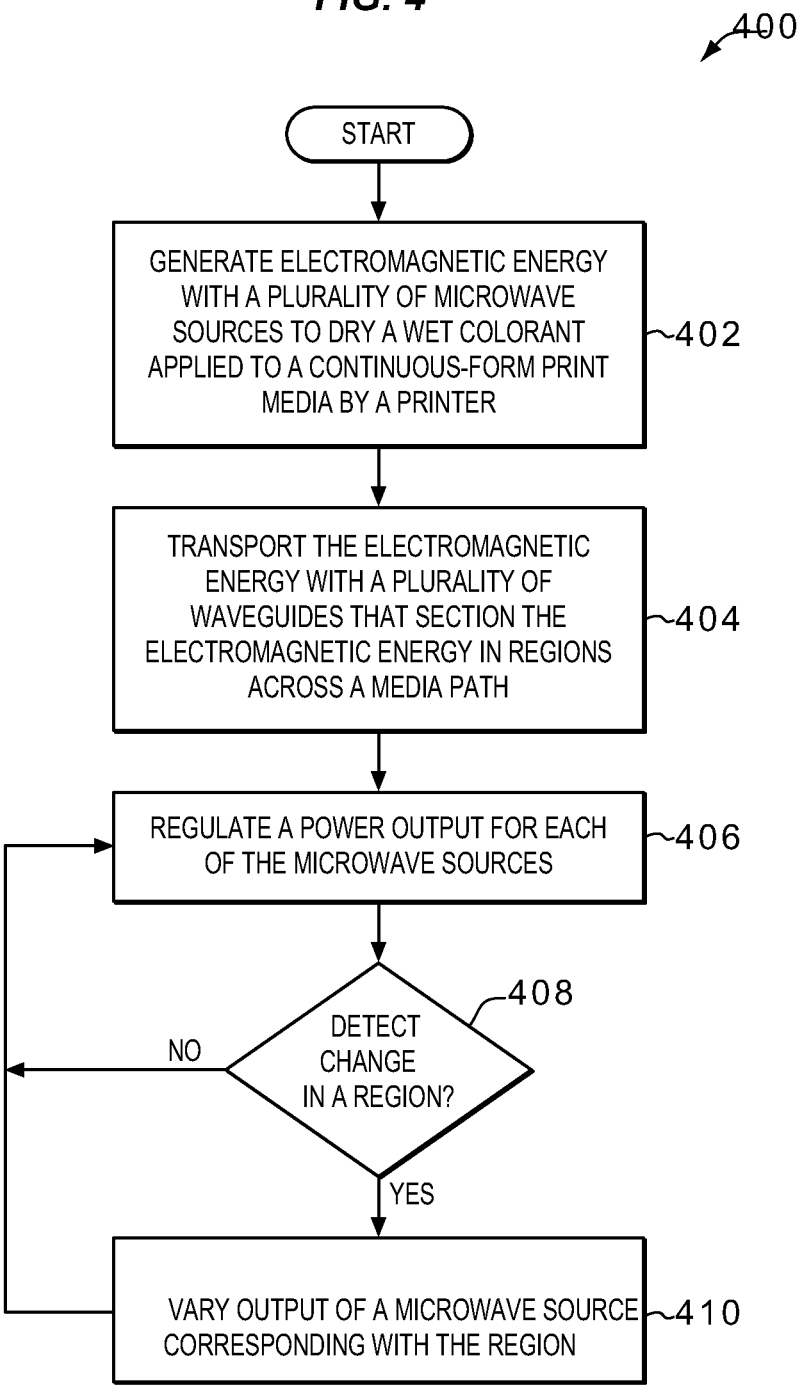
FIG. 4 is a flowchart of a method for operating a microwave dryer with multiple microwave energy sources in an exemplary embodiment.

FIG. 4 is a flow chart of a method 400 of operating microwave dryer 108 with multiple microwave energy sources 210-213 in an exemplary embodiment. Though discussed with respect to printing system 100 of FIG. 1 and microwave dryer 108 of FIG. 3, method 400 may apply to other systems. The steps of method 400 are not inclusive, may include additional or alternative steps, and may be performed in an alternate order.

In step 402, microwave energy sources 210-213 generate electromagnetic energy to dry a wet colorant applied to print media 112 by printer 102. In step 404, waveguides 220-223 transport the electromagnetic energy. As described earlier, passageway 230 in waveguides 220-223 receives print media 112 through waveguides 220-223 as print media 112 travels along media path 202. Furthermore, a long axis of each waveguide 220-223 is positioned along media path 202, and each waveguide 220-223 is electromagnetically coupled to a different microwave energy source 210-213 to section the electromagnetic energy into regions across the width of media path 202. For example, as shown in FIG. 3, microwave energy source 210 is electromagnetically coupled with waveguide 220 that contains electromagnetic energy in a first region across the width of media path 202. Microwave energy sources 211, 212, and 213 are similarly configured with waveguides 221, 222, and 223, respectively, such that the electromagnetic energy from each microwave energy source 210-213 is separated across the width of media path 202 along the dotted lines shown in FIG. 3.

In step 406, control system 330 regulates a power output for each microwave energy source 210-213. That is, control system 330 may independently direct an energy output of each microwave energy source 210-213 to direct differing amounts of electromagnetic energy in each region across the width of media path 202. Controller system 330 may therefore direct customized amounts of microwave energy across the width of media path 202 to adapt to a wide range of drying requirements of print media 112 as described below.

In step 408, control system 330 detects characteristics of print media 112 in one or more regions of media path 202. In doing so, control system 330 may determine whether there is a change in a characteristic of print media 112 in one or more regions of media path 202. In response to detecting a change in one or more characteristics of print media 112, method 400 proceeds to step 410 where control system 330 varies a power output of a microwave energy source corresponding to a waveguide of the region based on the characteristic of the print media. Otherwise, method 400 may return to step 406 to continuously regulate power output for each microwave energy source 210-213.

Control system 330 may correlate (e.g., in memory 334) a characteristic of print media 112 with one or more regions of media path 202, waveguides 220-223, microwave energy sources 210-213 and/or power output of microwave energy sources 210-213. Exemplary changes in print media 112 characteristics include a change in a type of print media 112, a change in a width of print media 112, a change in colorant density corresponding to a particular region in media path 202, and a change in a microwave energy absorption profile (or type) of colorant corresponding to a region in media path 202. In performing steps 406, 408, and/or 410, control system 330 may monitor/detect changes in characteristics of print media 112 in a variety of ways as described below.

In one embodiment, control system 330 analyzes bitmap data rasterized by print controller 104 to determine an amount of ink to be applied in each section of print media 112 corresponding with different regions across the width of media path 202. That is, control system 330 may use bitmap data to identify sections (i.e. regions) of print media 112 with different levels of colorant density and/or different levels of absorption of electromagnetic energy in the microwave spectrum. With colorant information in each section of print media 112 determined, control system 330 may control microwave energy sources 210-213 to output at power levels proportional to the colorant differences across sections of print media 112. Alternatively or additionally, control system 330 may use sensor 340 to capture an image of print media 112 and to determine colorant information in each section of print media 112.

Control system 330 may also calculate timing for directing power levels of microwave energy sources 210-213 based on colorant information. For instance, control system 330 may determine a travel speed of print media 112 to calculate a future length of time in which colorant density/absorption in a section of print media 112 remains constant, or within a predefined range, as it is exposed in waveguide 220-223 of a corresponding region across the width of media path 202. Control system 330 may then individually direct each microwave energy source 210-213 to output a proportional amount of electromagnetic energy at a time and duration determined by the calculated future length of time. To illustrate in one example, control system 330 may detect/calculate that there will be an absence of ink in one or more of the regions across the width of media path 202 for a period of time, and deactivate one or more microwave energy sources 210-213 corresponding with the one or more regions in response to a determination that the period of time exceeds a predetermined threshold (e.g., stored in memory 334).

In another embodiment, control system 330 may use sensor 340 to detect a change in width of print media 112. Alternatively or additionally, control system 330 may use sensor 340 to detect a change of justification (i.e. alignment) of print media 112 in media path 202 (e.g., edge-justified as shown in FIG. 3, center justified, etc.). With a change in width or justification of print media 112 detected, control system 330 may deactivate or reduce power for one or more microwave energy sources 210-213 corresponding with the at least one of the regions which are beyond print media 112 across the width of media path 202. To illustrate from an example in FIG. 3, control system 330 may deactivate microwave energy source 213 in response to a determination that print media 112 is edge-justified and has a width narrower than media path 202 such that print media 112 does not travel in waveguide 223. Alternatively or additionally, changes in type, width, and/or justification of print media 112 may be directed or indicated by a user via input at display 350 and/or data input from print engine controller 104.

Thus, using method 400, microwave dryer may vary the power output of one of microwave energy sources 210-213 that corresponds with the section of print media 112 associated with the detected change. If it is determined to change the microwave energy intensity in a region across the width of media path 202, control system 330 may directs the change in the power output of one or more microwave energy sources 210-213 corresponding with the region(s), thereby adapting microwave dryer 108 to a wide range of drying requirements.

Figure 5:
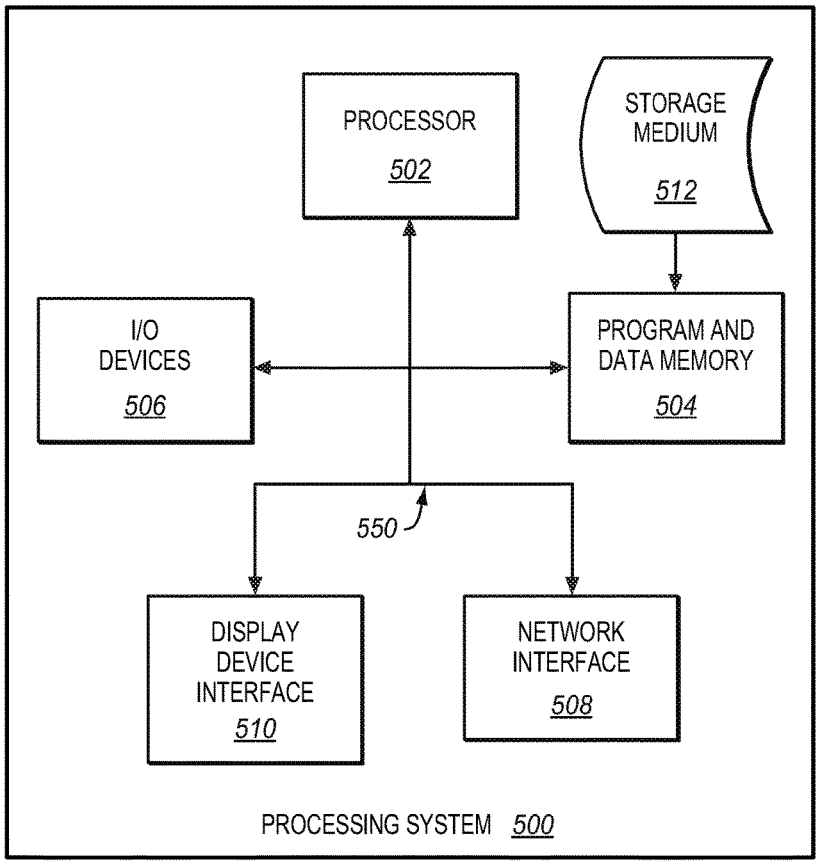
FIG. 5 illustrates a processing system configured to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of microwave dryer 108 to perform the various operations disclosed herein. FIG. 5 illustrates a processing system 500 configured to execute a computer readable medium embodying programmed instructions to perform desired functions in an exemplary embodiment. Processing system 500 is configured to perform the above operations by executing programmed instructions tangibly embodied on computer readable storage medium 512. In this regard, embodiments of the invention can take the form of a computer program accessible via computer-readable medium 512 providing program code for use by a computer or any other instruction execution system. For the purposes of this description, computer readable storage medium 512 can be anything that can contain or store the program for use by the computer.

Computer readable storage medium 512 can be an electronic, magnetic, optical, electromagnetic, infrared, or semiconductor device. Examples of computer readable storage medium 512 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 500, being suitable for storing and/or executing the program code, includes at least one processor 502 coupled to program and data memory 504 through a system bus 550. Program and data memory 504 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 506 (including but not limited to keyboards, displays, pointing devices, sensors, etc.) can be coupled either directly or through intervening I/O controllers. Network adapter interfaces 508 may also be integrated with the system to enable processing system 500 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 510 may be integrated with the system to interface to one or more presentation devices, such as printing systems and displays for presentation of presentation data generated by processor 502.

Although specific embodiments were described herein, the scope of the inventive concepts is not limited to those specific embodiments. The scope of the inventive concepts is defined by the following claims and any equivalents thereof.

What is claimed is:

1. A microwave dryer comprising:

a plurality of microwave energy sources configured to generate electromagnetic energy to dry a wet colorant applied to a continuous-form print media by a printer;

a plurality of waveguides configured to transport the electromagnetic energy, the waveguides including a passageway that is sized to pass the print media through the waveguides as the print media travels along a media path, a long axis of each the waveguides being positioned in a direction along the media path, and each waveguide coupled to a different microwave source to section the electromagnetic energy into regions that are distinct from one another in a direction across a width of the media path; and a controller configured to independently regulate a power output for each of the microwave energy sources;

wherein each of the plurality of waveguides are adjacent to and share a wall with at least one other of the plurality of waveguides.

2. The microwave dryer of claim 1, wherein:

the controller is configured to detect a first characteristic of the print media corresponding to a first of the regions of the media path, and to vary a power output of a first of the microwave energy sources corresponding to a first of the waveguides of the first of the regions based on the first characteristic of the print media.

3. The microwave dryer of claim 2, wherein:

the first characteristic of the print media is a first amount of ink in the first of the regions; and the controller is configured to vary the power output of the first of the microwave energy sources based on the first amount of ink.

4. The microwave dryer of claim 2, wherein:

the first characteristic of the print media is a first amount of ink in the first of the regions; and the controller is configured to detect the first amount of ink in the first of the regions based on a rasterization bitmap used for applying ink to the print media with a printhead.

5. The microwave dryer of claim 2, wherein:

the first characteristic of the print media is an absence of ink in the first of the regions; and the controller is configured to deactivate the power output of the first of the microwave energy sources based on the absence of ink in first of the regions.

6. The microwave dryer of claim 2, further comprising:

the first characteristic of the print media is a first amount of ink in the first of the regions; and the microwave dryer further comprises a first sensor to detect the first amount of ink in first of the regions.

7. The microwave dryer of claim 1, further comprising:

memory to correlate the microwave energy sources with the regions.

8. The microwave dryer of claim 1, wherein:

a characteristic of the print media is a width of the print media; and the controller is configured to deactivate the power output of a first of the microwave energy sources if a corresponding first of the regions is beyond the width of the print media in the direction across the media path.

9. The microwave dryer of claim 8, further comprising:

a sensor to detect the width of the print media; and memory to correlate the width of the print media with the regions beyond the width of the print media.

10. The microwave dryer of claim 1, further comprising:

the printer to apply the wet colorant to the continuous-form print media.

11. A method comprising:

generating electromagnetic energy with a plurality of microwave energy sources to dry a wet colorant applied to a continuous-form print media by a printer;

transporting the electromagnetic energy with a plurality of waveguides that include a passageway that is sized to pass the print media through the waveguides as the print media travels along a media path, a long axis of each the waveguides being positioned in a direction along the media path, and each waveguide is coupled to a different microwave energy source to section the electromagnetic energy into regions that are distinct from one another in a direction across a width of the media path; and independently regulating a power output for each of the microwave energy sources;

wherein each of the plurality of waveguides are adjacent to and share a wall with at least one other of the plurality of waveguides.

12. The method of claim 11, further comprising:

detecting a first characteristic of the print media corresponding to a first of the regions of the media path; and varying a power output of a first of the microwave energy sources corresponding to a first of the waveguides of the first of the regions based on the first characteristic of the print media.

13. The method of claim 12, wherein:

the first characteristic of the print media is a first amount of ink in the first of the regions; and the method further comprises varying the power output of the first of the microwave energy sources based on the first amount of ink.

14. The method of claim 12, wherein:

the first characteristic of the print media is a first amount of ink in the first of the regions; and the method further comprises detecting the first amount of ink in the first of the regions based on a rasterization bitmap used for applying ink to the print media with a printhead.

15. The method of claim 12, wherein:

the first characteristic of the print media is a width of the print media; and the method further comprises deactivating the power output of the first of the microwave energy sources if the first of the regions is beyond the width of the print media in the direction across the media path.

16. A non-transitory computer readable medium embodying programmed instructions which, when executed by a processor, are operable for performing a method comprising:

directing a plurality of microwave energy sources to generate electromagnetic energy to dry a wet colorant applied to a continuous-form print media by a printer by transporting the electromagnetic energy with a plurality of waveguides that include a passageway that is sized to pass the print media through the waveguides as the print media travels along a media path, wherein a long axis of each the waveguides are positioned in a direction along the media path, and wherein each waveguide is coupled to a different microwave source to section the electromagnetic energy into regions that are distinct from one another in a direction across a width of the media path; and independently regulating a power output for each of the microwave energy sources;

wherein each of the plurality of waveguides are adjacent to and share a wall with at least one other of the plurality of waveguides.

17. The medium of claim 16, wherein the method further comprises:

detecting a first characteristic of the print media corresponding to a first of the regions of the media path; and varying a power output of a first of the microwave energy sources corresponding to a first of the waveguides of the first of the regions based on the first characteristic of the print media.

18. The medium of claim 17, wherein:

the first characteristic of the print media is a first amount of ink in the first of the regions; and the method further comprises varying the power output of the first of the microwave energy sources based on the first amount of ink.

19. The medium of claim 17, wherein:

the first characteristic of the print media is a first amount of ink in the first of the regions; and the method further comprises detecting the first amount of ink in the first of the regions based on a rasterization bitmap used for applying ink to the print media with a printhead.

20. The medium of claim 17, wherein:

the first characteristic of the print media is a width of the print media; and the method further comprises deactivating the power output of the first of the microwave energy sources if the first of the regions is beyond the width of the print media in the direction across the media path.

21. The medium of claim 16, wherein the method further includes:

correlating the microwave energy sources with the regions in memory.

* * * * *